US005182599A

United States Patent [19]

Kinoshita

[11] Patent Number: 5,182,599

[45] Date of Patent: Jan. 26, 1993

[54] MULTI-COLOR IMAGE FORMING APPARATUS AND METHOD OF SETTING IMAGE DATA FOR SAME

[75] Inventor: Naoyoshi Kinoshita, Aichi, Japan

[73] Assignee: Minolta Camera Kabushiki Kaisha, Osaka, Japan

[21] Appl. No.: 741,739

[22] Filed: Aug. 7, 1991

[30] Foreign Application Priority Data

Aug. 8, 1990 [JP] Japan ..... 2-210737

[51] Int. Cl.[5] ..... G03G 15/00; G03G 15/01

[52] U.S. Cl. ..... 355/208; 355/246; 355/326

[58] Field of Search ..... 355/208, 214, 246, 326

[56] References Cited

U.S. PATENT DOCUMENTS 5,122,842 6/1992 Rimai et al. ..... 355/326

FOREIGN PATENT DOCUMENTS 60-24470 6/1985 Japan .

61-248068 11/1986 Japan ..... 355/208

*Primary Examiner*—Joan H. Pendegrass

*Attorney, Agent, or Firm*—Burns, Doane, Swecker & Mathis

[57] ABSTRACT

An image forming method and an image forming apparatus in which a plurality of kinds of toner images are supported on an image support member, the method comprising the steps of: forming, on the basis of first image data, a first toner image on the image support member with first toner; detecting the first toner image so as to output a detection signal; forming, on the basis of second image data, a second toner image on the image support member with second toner which is different from the first toner; and executing, by an output of the detection signal, a program for setting conditions for forming the second toner image.

25 Claims, 17 Drawing Sheets

*Fig. 7*

GT

| | Y | | M | | C | | BK | |
|---|---|---|---|---|---|---|---|---|
| Diff. from ref. value (V) | VG (V) | VL (V) | VG (V) | VL (V) | VG (V) | VL (V) | VG (V) | VL (V) |
| +1.75~ | -160 | -16 | -120 | -12 | -80 | -8 | -40 | -4 |
| +1.25~+1.74 | -120 | -12 | -90 | -9 | -60 | -6 | -30 | -3 |
| +0.75~+1.24 | -80 | -8 | -60 | -6 | -40 | -4 | -20 | -2 |
| +0.25~+0.74 | -40 | -4 | -30 | -3 | -20 | -2 | -10 | -1 |
| -0.25~+0.24 | ±0 | ±0 | ±0 | ±0 | ±0 | ±0 | ±0 | ±0 |
| -0.75~-0.24 | +40 | +4 | +30 | +3 | +20 | +2 | +10 | +1 |
| -1.25~-0.74 | +80 | +8 | +60 | +6 | +40 | +4 | +20 | +2 |
| -1.75~-1.24 | +120 | +12 | +90 | +9 | +60 | +6 | +30 | +3 |
| ~-1.74 | +160 | +16 | +120 | +12 | +80 | +8 | +40 | +4 |

MULTI-COLOR IMAGE FORMING APPARATUS AND METHOD OF SETTING IMAGE DATA FOR SAME

BACKGROUND OF THE INVENTION

The present invention relates to adjustment of image quality in an image forming apparatus such as a copying apparatus, a page printer, etc.

In color copying apparatuses employing an electrophotographic process, toner images of primary colors of yellow (Y), magenta and cyan (C) are sequentially formed and are placed on each other so as to form a color copied image. In the known color copying apparatuses, density of the toner image of each color, i.e. state of development by the toner of each color is an important factor in determination of color reproducibility (image quality).

Therefore, in the known color copying apparatuses, an AIDC pattern (reference toner image for adjusting development density) for the toner of each color is produced on a photosensitive member at a predetermined timing such that densities of the AIDC patterns are detected by respective photoelectric type AIDC sensors. In response of the detection signals, setting values of corona charging quantity for the photosensitive member, amount of exposure for charge erasing, developing bias voltage, etc. are changed in image forming processes of respective colors at the time of copying such that image quality is adjusted.

However, in the known color copying apparatuses, since the AIDC patterns corresponding to the toners of Y, M and C, respectively are sequentially produced, a long period is required for adjusting image quality, thereby resulting in delay in start of copying. Furthermore, the known color copying apparatuses have such a drawback that although the AIDC patterns occupy a small area, the toners of the respective colors are consumed for producing the AIDC patterns.

SUMMARY OF THE INVENTION

Accordingly, an essential object of the present invention is, with a view to eliminating the above mentioned inconveniences, to minimize consumption of toner and reduce period required for adjusting image quality.

In order to accomplish this object of the present invention, an image forming apparatus provided with a plurality of developing means having different developing colors for developing latent images on a photosensitive member, respectively according to the present invention comprises: an image quality adjustment table for storing interrelations of image forming characteristics for the respective developing means; wherein a density of an image developed by a specific one of the developing means is detected such that image forming conditions of the remaining developing means are set in accordance with the detected density by using the image quality adjustment table.

The image quality adjustment table stores the interrelations of the image forming characteristics of a plurality of the developing means having the different developing colors, respectively. A latent image for image quality adjustment is formed on the photosensitive member and is developed by the specific developing means. By detecting the density of the image developed by the specific developing means, an imaging state of the specific developing means is detected. By referring to the image quality adjustment table, imaging states of the remaining developing means can be detected from the imaging state of the specific developing means without the need for performing development for image quality adjustment by using the remaining developing means. Furthermore, the image forming conditions of the remaining developing means are set such that the imaging states of the remaining developing means are made proper.

BRIEF DESCRIPTION OF THE DRAWINGS

This object and features of the present invention will become apparent from the following description taken in conjunction with the preferred embodiment thereof with reference to the accompanying drawings, in which:

FIG. 7 is a view showing contents of an image quality adjustment table;

Before the present invention proceeds, it is to be noted that like parts are designated by like reference numerals throughout several views of the accompanying drawings.

DETAILED DESCRIPTION OF THE INVENTION

Figure 1:
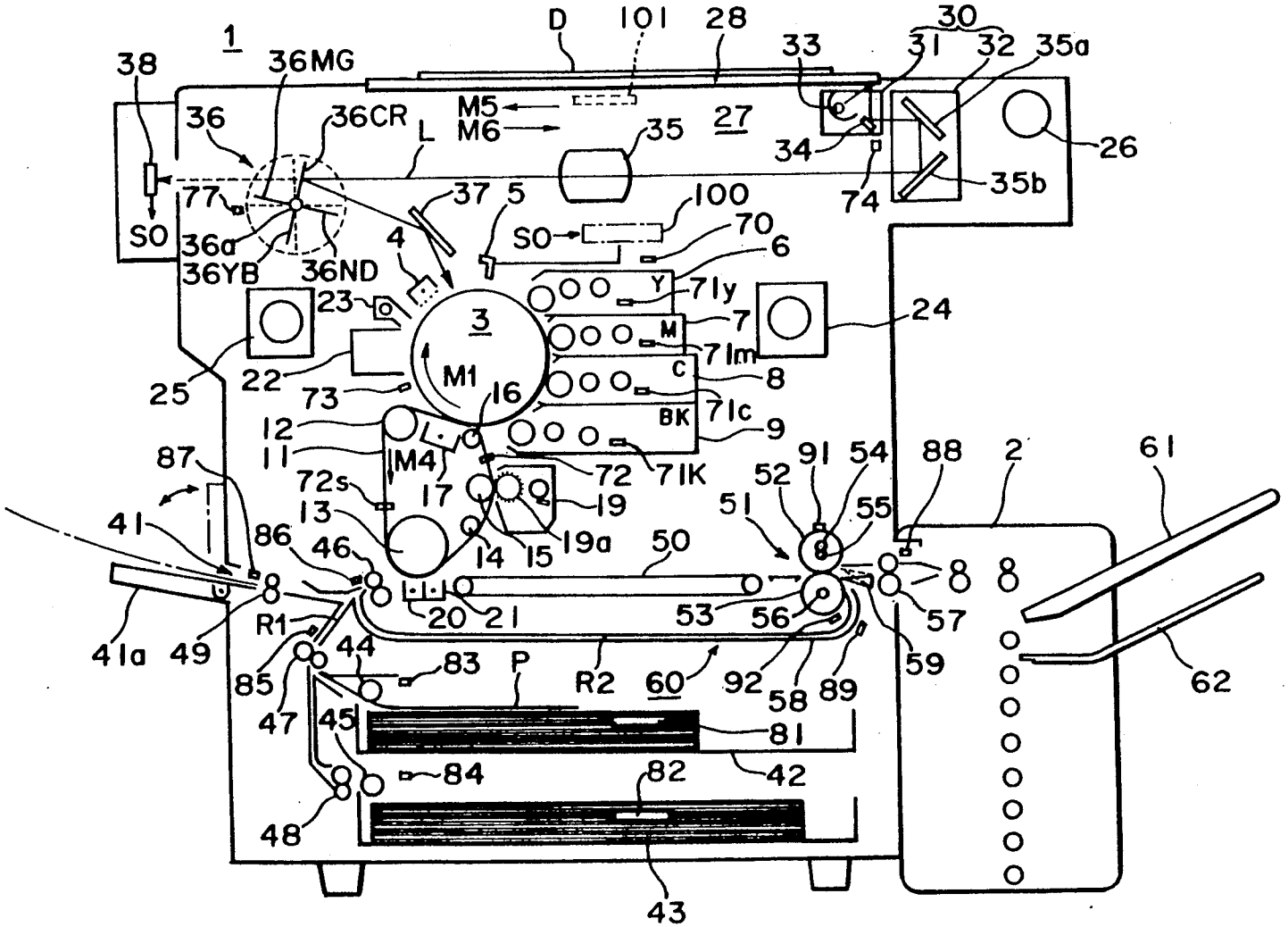
FIG. 1 is a schematic sectional view showing a copying apparatus according to the present invention.

Referring now to the drawings, there is shown in FIG. 1, a copying apparatus 1 according to one embodiment of the present invention. At a corona charging portion from which exposure light (scanning light) from an optical system 27 is intercepted, namely, at an image nonforming portion, a latent image APE of an AIDC pattern AP is formed on a surface of a photosensitive drum 3 through selective charge erasing by an editing eraser 5. When the AIDC pattern AP is produced, a grid voltage VG of a corona charger 4 is set to a specific value to change the surface of the drum 3 at a predetermined latent image voltage-potential (Vo).

Figure 2:
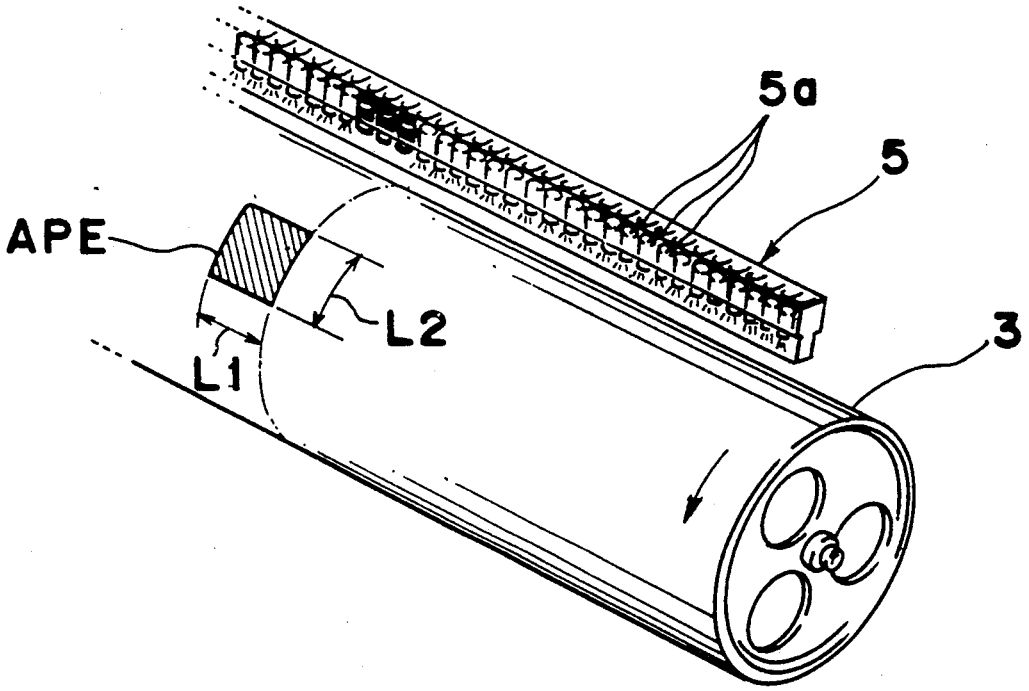
FIG. 2 is a view showing formation of a latent image of an AIDC pattern by an editing eraser.

As shown in FIG. 2, the editing eraser 5 is constituted by an LED array in which a number of LEDs 5*a* are linearly arranged in a holder extending in an axial direction of the photosensitive drum 3. The editing eraser 5 is arranged to partially erase a latent image or electric charge on the photosensitive drum 3 by controlling turning on of the respective LEDs 5*a*.

When the latent image APE of the AIDC pattern AP is formed by the editing eraser 5, control is performed such that LEDs 5*a* corresponding to a width L1 of the latent image APE are turned off for a period corresponding to a length L2 of the latent image APE and turned on during the remaining period, while the remaining LEDs 5*a* held in the ON state. The latent image APE is developed into the AIDC pattern AP by developing devices 6 to 9. Density of the produced AIDC pattern AP is detected by an AIDC sensor 73.

The developing devices 6, 7, 8 and 9 contain developers (mixtures of toner and carrier) of colors of yellow (Y), magenta (M), cyan (C) and black (BK), respectively. In order to control the developers such that toner concentrations of these developers are maintained at fixed values at all times, toner concentration sensors (ATDC sensors) 71*y*, 71*m*, 71*c* and 71*k* are provided, respectively. The developing devices deposit the above color toners (Y), (M), (C) and (BK) in accordance with predetermined bias voltages as the well-known conventional developing devices.

A transfer belt 11 is provided for temporarily holding toner images developed on the photosensitive drum 3 by the developing devices 6 to 9 so as to transfer (secondary transfer) the toner images onto a copy paper sheet P. The transfer belt 11 is trained over a plurality of rollers 12 to 16 and is supported so as to be rotated counterclockwise (in the direction of the arrow M4) while being held in contact with the photosensitive drum 3 at all times.

A transfer charger 17 for transferring (primary transfer) the toner images onto the transfer belt 11 from the photosensitive drum 3 is provided inside the transfer belt 11. Meanwhile, outside the transfer belt 11 are provided a transfer charger 20 for secondary transfer, a charge eraser 21 for separating the copy paper sheet P from the transfer belt 11 and a belt cleaner 19 having a fur brush 19*a* for cleaning an outer surface of the transfer belt 11. The fur brush 19*a* is movably provided so as to be selectively brought into pressing contact with the transfer belt 11 at the time of cleaning and spaced away from the transfer belt 11.

Meanwhile, belt mark sensors 72 and 72*s* for detecting rotational angular positions of the transfer belt 11 are fixedly provided along the transfer belt 11 between the rollers 15 and 16 and between the rollers 12 and 13, respectively. An optical platform glass 28 and a detector 101 for detecting size of an original document D placed on the original platform glass 28 are provided at an upper face of the copying apparatus 1.

Furthermore, the optical system 27 is provided at an upper portion of the copying apparatus 1. The optical system 27 is substantially constituted by a scanner 30, a main lens 35, a mirror device 36 for performing color separation exposure, a fixed mirror 37 and a color image sensor 38 and scans the original document D a&: the time of forward travel of the scanner 30 so as to effect exposure of the photosensitive drum 3. The scanner 30 is reciprocatingly provided below the original platform glass 28 so as to be reciprocated in the forward direction of the arrow M5 and in the backward direction of the arrow M6. The main lens 35 is adjusted in position in accordance with copying magnification. The fixed mirror 37 is provided for guiding to an exposure point on the photosensitive drum 3, scanning light L reflected by mirrors attached to the mirror device 36. The color image sensor 38 is provided for receiving the scanning light L transmitted through the mirrors of the mirror device 36.

The scanner 30 is constituted by a first slider 31 and a second slider 32. The first slider 31 includes an exposure lamp 33 and a mirror 34, while the second slider 32 includes mirrors 35*a* and 35*b*. The exposure lamp 33 is capable of changing its exposure amount in accordance with an applied voltage thereto. Completion of backward travel of the scanner 30, namely return of the scanner 30 to a reference position (home position) is detected by a scanner home switch 74 formed by a photosensor.

The mirror device 36 has a half mirror 36ND and three filter mirrors 36YB, 36MG and 36CR. In the half mirror 36ND, ratio of transmission to reflection of the scanning light L is 6:4. The half mirror 36ND and the filter mirrors 36YB, 36MG and 36CR extend radially from a shaft 36*a* and axially along the shaft 36*a* in parallel with the shaft 36*a* so as to be circumferentially spaced 90° from each other. Upon rotation of the mirror device 36, one of the mirrors 36ND, 36YB, 36MG and 36CR is positioned through selective changeover. In the mirror filters 36YB, 36MG and 36CR corresponding to toners of colors of Y, M and C, respectively, each of color separation filters of blue (B), green (G) and red (R) is deposited on a surface of a mirror such that the mirror and each color separation filter are formed integrally.

In exposure scanning for image formation, a reflecting surface of a selected one of the half mirror 36ND and the filter mirrors 36YB, 36MG and 36CR is so positioned as to be inclined clockwise through about 10° relative a vertical plane such that the scanning light L is guided to the exposure point on the photosensitive drum 3. Meanwhile, in preliminary scanning for reading images of the original document D, which is performed prior to exposure scanning, the half mirror 36ND is selected and is positioned vertically so as to intersect with a direction of incidence of the scanning light L at right angles so as to improve modulation transfer function (MTF) of the image sensor 38, i.e. image forming power. In order to determine a home position of the mirror device 36, a sensor 77 is provided for detecting rotational position of the mirror device 36. In FIG. 1, the filter mirror 36CR is selected and is positioned at its image forming position.

Hereinbelow, the half mirror 36ND and the filter mirrors 36YB, 36MG and 36CR may be referred to as "an ND filter, a B filter, a G filter and an R filter on the basis of their color separation characteristics, respectively or whole of these mirrors may be referred to as "a mirror 36*b*".

On the other hand, an upper paper cassette 42 containing the copy paper sheets P and a lower paper cassette 43 containing the copy paper sheets P are loaded into a lower portion of the copying apparatus 1. By opening a door 41*a* on a left side face of the copying apparatus 1, a manual paper feeding opening 41 for performing manual feed of the copy paper sheets P is uncovered. The upper paper cassette 42, the lower paper cassette 43 and the manual paper feeding opening 41 are selectively used for paper feeding. In the upper and lower paper cassettes 42 and 43, pickup rollers 44 and 45 for picking up the copy paper sheets P one sheet by one sheet, paper size sensors 81 and 82 for detecting size of the copy paper sheets P and paper empty sensors 83 and 84 for detecting depletion of the copy paper sheets P are provided, respectively. Meanwhile, a manual feed sensor 87 for detecting insertion of the copy paper sheet P is provided at the manual paper feeding opening 41.

The copy paper sheet P fed from the upper paper cassette 42 is transported by paper feeding rollers 47 to timing rollers 46 where the copy paper sheet P is set in waiting state. Likewise, the copy paper sheet P fed from the lower paper cassette 43 is conveyed by paper feeding rollers 48 and 47 to the timing rollers 46 where the copy paper sheet P is set in waiting state. Meanwhile, the copy paper sheet P inserted into the manual paper feeding opening 41 is carried to the timing rollers 46 by manual paper feeding rollers 49. In the vicinity of the paper feeding rollers 47, there is provided a paper sensor 85 for detecting presence and absence of the copy paper sheet P in a paper feeding passage R1 between the paper feeding rollers 47 and the timing rollers 46. In the vicinity of the timing rollers 46, there is provided a timing sensor 86 for detecting a leading edge of the passing copy paper sheet P.

The copy paper sheet P in waiting state is further transported synchronously with the transfer belt 11 upon rotation of the timing rollers 46. Thus, secondary transfer of a toner image from the transfer belt 11 to the copy paper sheet P is performed at a transfer position. Subsequently, the copy paper sheet P is carried to a fixing unit 51 by a transport belt 50 having a linear distance corresponding to that of an A4-sized copy paper sheet.

The fixing unit 51 is constituted by an upper roller 52 and a lower roller 53 so as to fix the toner image on the copy paper sheet P by fusing the toner image. The upper roller 52 has heater lamps 54 and 55, while the lower roller 53 has a heater lamp 56. Temperature sensors 91 and 92 each formed by a thermistor are, respectively, provided in the vicinity of the upper and lower rollers 52 and 53. The copy paper sheet P having a desired copied image formed thereon by fixing of the toner image is carried to a sorter 2 by discharge rollers 57 so as to be ejected onto a copy receiving tray 61 or a sorting ben 62 in the sorter 2. A discharge sensor 88 is provided in the vicinity of the discharge rollers 57.

The copying apparatus 1 of this embodiment is provided with a return device 60 which is used for refixing at the time of copying in OHP mode. The return device 60 includes a transport mechanism 58 having a return passage R2, a changeover claw 59 and a paper sensor 89 for detecting the copy paper sheet P to be returned. In FIG. 1, the copying apparatus 1 further includes a main motor 24 for driving portions associated mainly with feed and transport of the copy paper sheets P, a PC motor 25 for driving the photosensitive drum 3, the transfer belt 11, etc. and a cooling fan 26.

In the copying apparatus 1 of the above described arrangement, it is possible to form a monochromatic copied image of each of the colors of Y, M, C and BK, a composite monochromatic copied image of each of the colors of R (Y and M), G (Y and C) and B (M and C) in which the toner images of two of the primary colors are placed on each other and a color (full color) copied image in which the toner images of the primary colors are placed on one another. Changeover of such copying modes is performed by using various switches arranged on an operating panel (not shown).

When the monochromatic copied image or the composite monochromatic copied image is formed, exposure scanning of the original document D is performed by using the half mirror 36ND and a latent image formed on the photosensitive drum 3 is developed by using one of the developing devices 6 to 9 in accordance with a designated color so as to be transferred onto the transfer belt 11. In the case of the composite monochromatic copied image, exposure scanning of the same original document P is again performed by the half mirror 36ND and a toner image developed by using another on of the copying devices 6 to 9 is transferred onto the transfer belt 11 on which the toner images of the two colors are placed on each other.

Meanwhile, when the color copied image is formed, the toners of the four colors of Y, M, C and BK are sequentially used in the copying apparatus 1 so as to improve reproducibility of a black portion. Namely, exposure scanning is performed for the same copy paper sheet P a total of four times and the B, G, R and ND filters and the developing devices 6 to 9 are selectively changed over at the time of each scanning such that formation of latent images obtained by color separation of the original document D and development of the latent images are performed. Then, the toner images are sequentially transferred onto the transfer belt 11 such that the toner images of the respective colors are placed on one another on the transfer belt 11.

When the toner images of the respective colors are placed on one another (hereinbelow, referred to as "multiple transfer"), the respective toner images are required to be transferred at an identical position on the transfer belt 11. Thus, in the copying apparatus 1 of this embodiment, timing of start of travel of the scanner 30, namely, timing of start of formation of the latent images on the photosensitive drum 3 is controlled on the basis of timing of generation of a belt mark signal S10 from the belt mark sensor 72 or **72*s***.

Meanwhile, in the case of formation of the color copied image, preliminary scanning is performed so as to discriminate the images of the original document D into a color image portion having chromatic colors and a monochromatic image portion formed by only achromatic colors. At the time of image formation by the toners of Y, M and C, the latent image corresponding to the monochromatic image portion is erased by the editing eraser 5 prior to development. On the contrary, at the time of image formation by the toner of BK, the latent image corresponding to the color image portion is erased prior to development. Namely, the color image portion is reproduced by multiple transfer of the toners of Y, M and C, while the monochromatic image portion is reproduced by only the toner of BK. As a result, in the case of an image of characters or lines having a small line width, which are usually depicted in black, it becomes possible to obtain a clear copied image free from delicate positional noncoincidence of the color. Furthermore, in the case of a multicolor image such as a color photograph, it becomes possible to obtain a natural copied image having excellent reproducibility of the colors.

Figure 3:
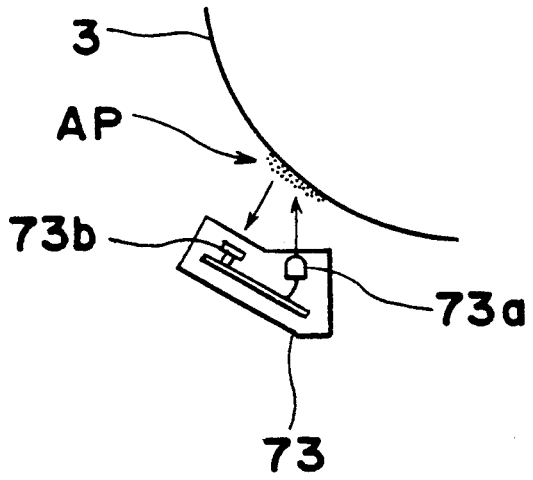
FIG. 3 is a view showing an AIDC sensor.

FIG. 3 shows the AIDC sensor 73. The AIDC sensor 73 is constituted by a light emitting diode **73*a* and a photosensor 73*b*. The light emitting diode 73*a* is disposed such that light emitted by the light emitting diode 73*a* is directed towards the photosensitive drum 3. Meanwhile, the photosensor 73*b* is so disposed as not to receive light of regular reflection effected by the photosensitive drum 3. Namely, in the case where toner adheres to the surface of the photosensitive drum 3, light from the light emitting diode 73*a* is subjected to irregular reflection by the toner and thus, is received by the photosensor 73*b*. As a result, the photosensor 73*b*** outputs a detection signal S1. However, in the case where there is no toner on the surface of the photosensitive drum 3, light from the light emitting diode 73*a* is not incident upon the photosensor 73*b*.

Figure 4:
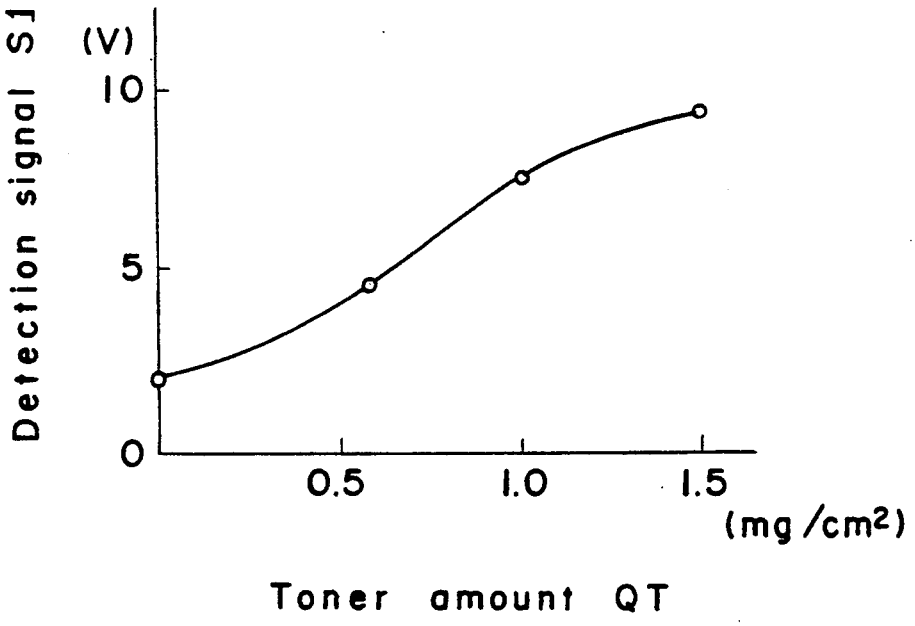
FIG. 4 is a graph showing one example of relation between amount of toner adhering to a photosensitive drum and detection signal of the AIDC sensor of FIG. 3.

FIG. 4 shows one example of relation between amount QT of toner adhering to the photosensitive drum 3 and the detection signal S1. As the amount QT of the toner adhering to the photosensitive drum 3 becomes larger, accordingly, density of the toner image becomes higher, quantity of light received by the photosensor 73*b* is increased further. Meanwhile, magnitude of the detection signal S1 outputted by the photosensor 73*b* is increased in response to increase of the amount QT of the toner adhering to the photosensitive drum 3. Such relation between the amount QT of the toner and the detection signal S1 applies to the toners of the colors of Y, M, C and BK substantially identically. On the other hand, variations of the amount QT of the toner caused by environmental changes of temperature or humidity or lapse of time are different from one another in the toners of the colors of Y, M, C and BK mainly due to differences in components of the toners.

Figure 5:
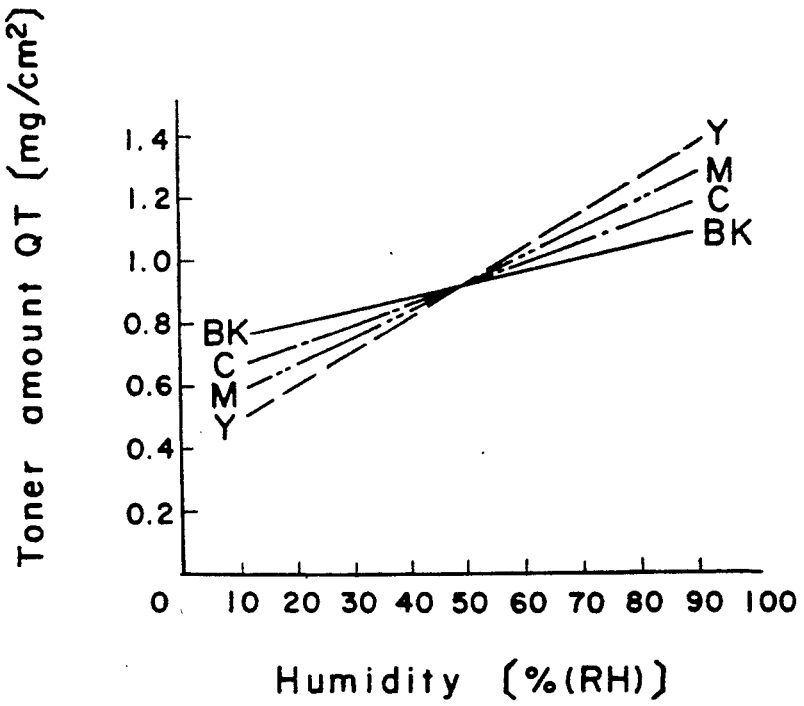
FIG. 5 is a graph showing one example of relation between humidity and amount of toner adhering to the photosensitive drum.

FIG. 5 shows one example of relation between humidity in the copying apparatus 1 and the amount QT of each of the toners of the respective colors adhering to the photosensitive drum 3. Generally, the amount QT of the toner adhering to the photosensitive drum 3 is inclined to increase in response to rise of humidity for the following reason. Namely, in response to rise of humidity, quantity of charging of the toner in the developer is reduced, so that quantity of charging of the photosensitive drum 3 is increased relative to quantity of charging of the toner and thus, a larger amount of the toner particles adhere to the photosensitive drum 3. However, degree of above mentioned increase of the amount QT of the toner adhering to the photosensitive drum 3 in response to rise of humidity is different from one another in the toners of the respective colors and is arranged in reducing order of Y, M, C and BK.

Meanwhile, in order to obtain proper reproducibility of colors of a copied image, it is necessary to maintain the amount QT of each of the toners of the respective colors at a predetermined value. To this end, an image quality adjustment table GT corresponding to characteristics of the toners of the respective colors shown in FIG. 5 is provided in the copying apparatus 1 as shown in FIG. 7. On the basis of the image quality adjustment table GT, detection result of the detection signal S1 is fed back to control for the corona charger 4, the exposure lamp 33, etc. such that image quality is adjusted.

Figure 6:
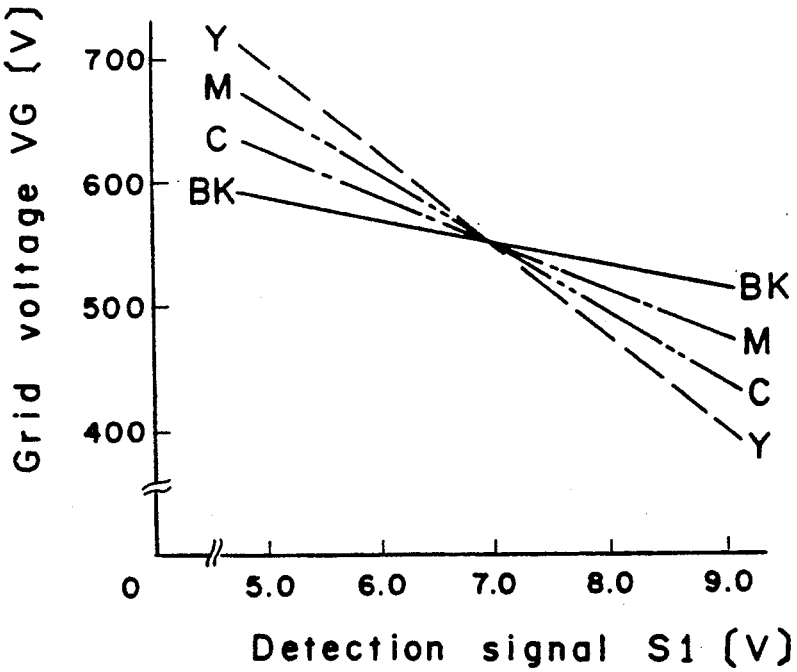
FIG. 6 is a graph showing one example of relation between detection signal of the AIDC sensor and grid voltage of a corona charger.

FIG. 6 shows one example of relation between the detection signal S1 and a grid voltage VG of the corona charger 4, while FIG. 7 shows contents of the image quality adjustment table GT. When the detection signal S1 of the AIDC sensor 73 exceeds a reference value of, for example, 7 V due to increase of the amount QT of the toner caused by rise of humidity in the copying apparatus 1, etc., the grid voltage VG of the corona charger 4 is lowered so as to decrease quantity of charging of the photosensitive drum 3 such that the amount QT of the toner is reduced. In addition, a voltage VL for turning on the exposure lamp 33 is lowered so as to obtain proper density gradient. On the contrary, when the detection signal S1 is lower than the reference value, the grid voltage VG and the voltage VL are raised.

For example, when the detection signal S1 exceeds the reference value in a range between 0.25 and 0.74 V as shown in FIG. 7, the grid voltage VG and the voltage VL are lowered by 40 V and 4 V, respectively for image formation of Y. Meanwhile, in the case of image formation of M, the grid voltage VG and the voltage VL are, respectively, lowered by 30 V and 3 V. Furthermore, also in image formation of C and BK, the grid voltage VG and the voltage VL are lowered. By changing setting values of the grid voltage VG and the voltage VL for the respective colors in the image quality adjustment table GT as described above, the amount QT of each of the toners of the colors of Y, M, C and BK is corrected to a proper value and thus, a copied image having excellent reproducibility of each color can be obtained.

Interrelation among amounts of the toners of the colors of Y, M, C and BK adhering to the photosensitive drum 3 due to environmental changes is stored in the image quality adjustment table GT. Therefore, when the setting values of the image quality adjustment table GT are changed, it is not necessary to produce the AIDC patterns AP for all the four colors. Thus, the AIDC pattern AP is required to be produced for only one of the four colors and the image forming conditions of other colors may be set in accordance with the detection signal S1 on the basis of the image quality adjustment table GT. In this embodiment, the AIDC pattern AP is produced only for the toner of the color of Y and the toners of other colors of M, C and BK are corrected based on the detection signal S1 for the toner of the color of Y.

Figure 8:
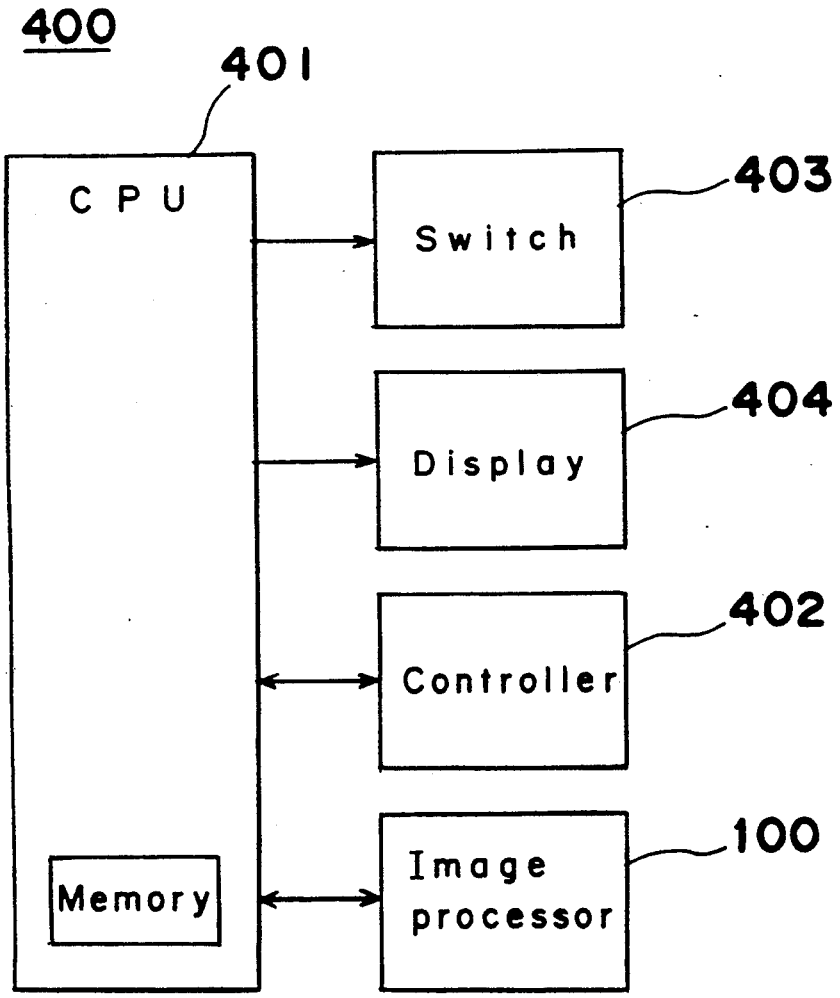
FIG. 8 is a block diagram of a control circuit of the copying apparatus of FIG. 1.

FIG. 8 shows a control circuit 400 of the copying apparatus 1. The control circuit 400 includes a CPU 401 acting as a main unit for controlling whole operation of the copying apparatus 1, a controller 402 for not only controlling drive of various portions such as the scanner 30, the exposure lamp 33, the main lens 35 and the corona charger 4 but controlling the editing eraser 5 so as to produce the AIDC pattern AP and an image processor 100 for performing image processing by using various switches 403 and a display unit 404 provided on the operating panel (not shown), the color image sensor 38, etc. Although not specifically shown, sensors including the AIDC sensor 73, the scanner home switch 74 and the sensor 77 for detecting rotational position of the mirror device 36 are connected to the CPU 401 through proper interfaces. The CPU 401 incorporates a memory for storing programs, data, the image quality adjustment table GT, etc.

Meanwhile, control circuits for a regulator of the exposure lamp 33 and the corona charger 4, which constitute a portion of the controller 402, each have a data line of several bits to be controlled by the CPU 401 such that output voltages of the regulator of the exposure lamp 33 and the corona charger 4 are varied by changing data from the CPU 401.

Figure 9:
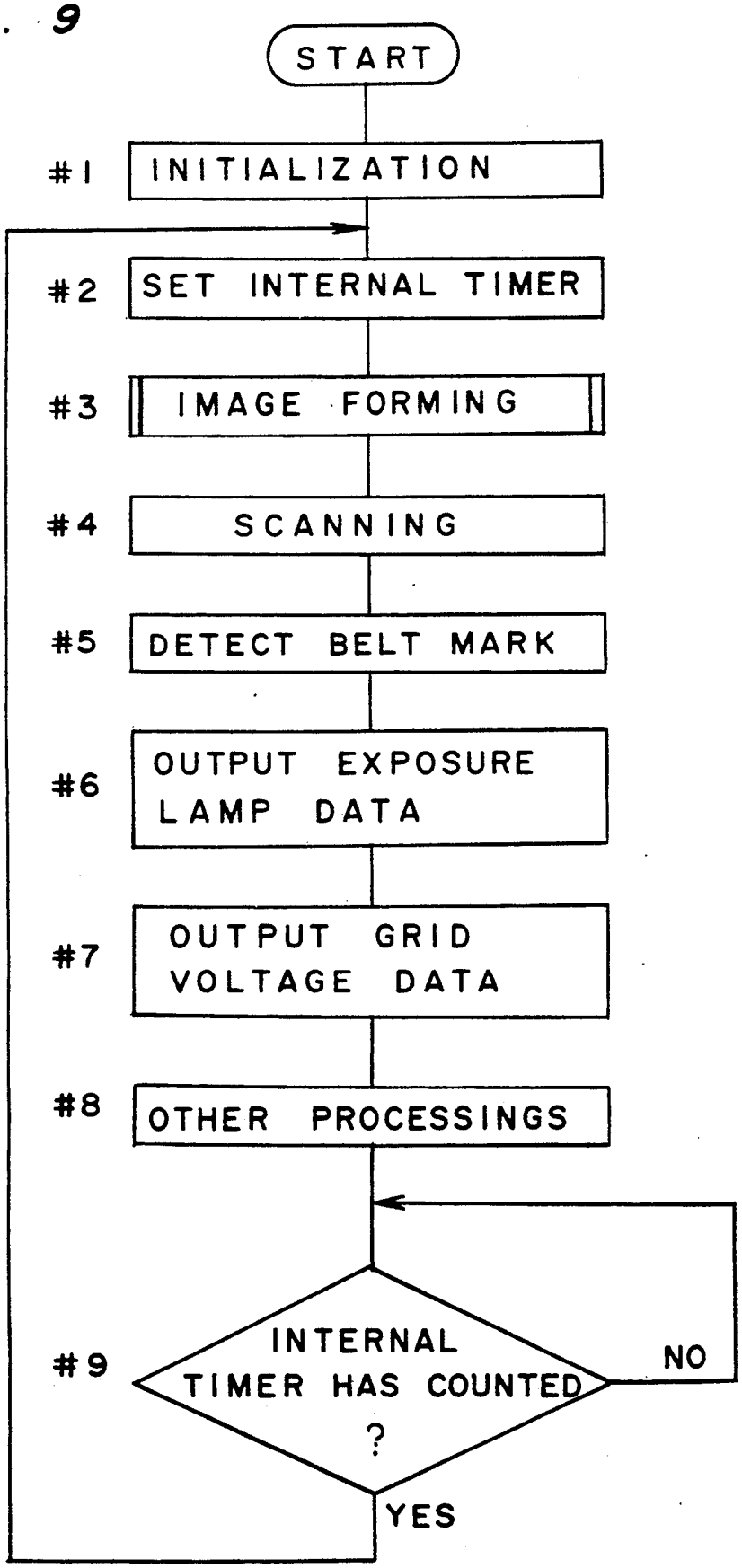
FIG. 9 is a main flow chart showing operation of a CPU of the copying apparatus of FIG. 1 schematically.
Figure 10A:
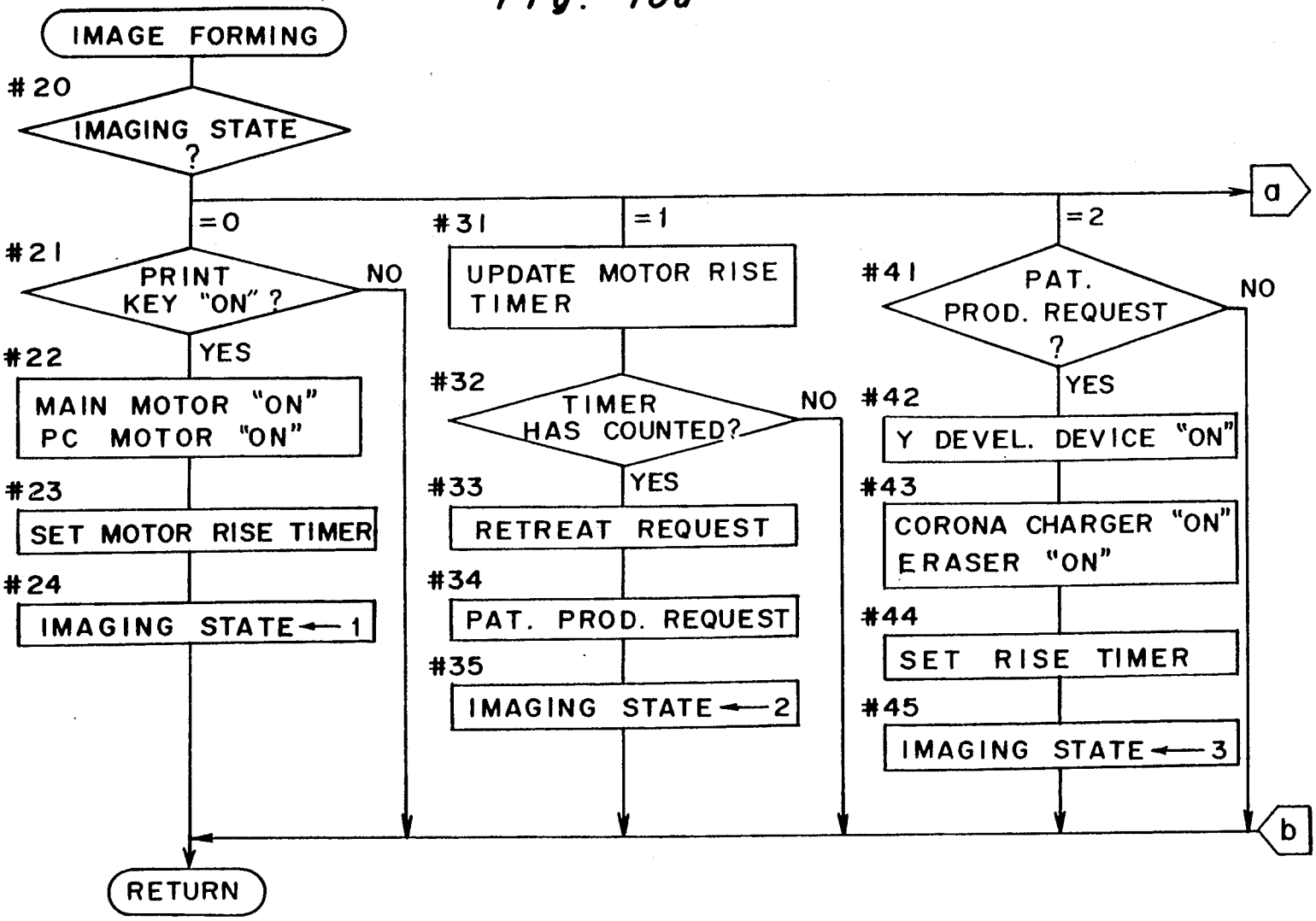
FIGS. 10*a* to 10*j* are flow charts showing image forming processing in the copying apparatus of FIG. 1.
Figure 10B:
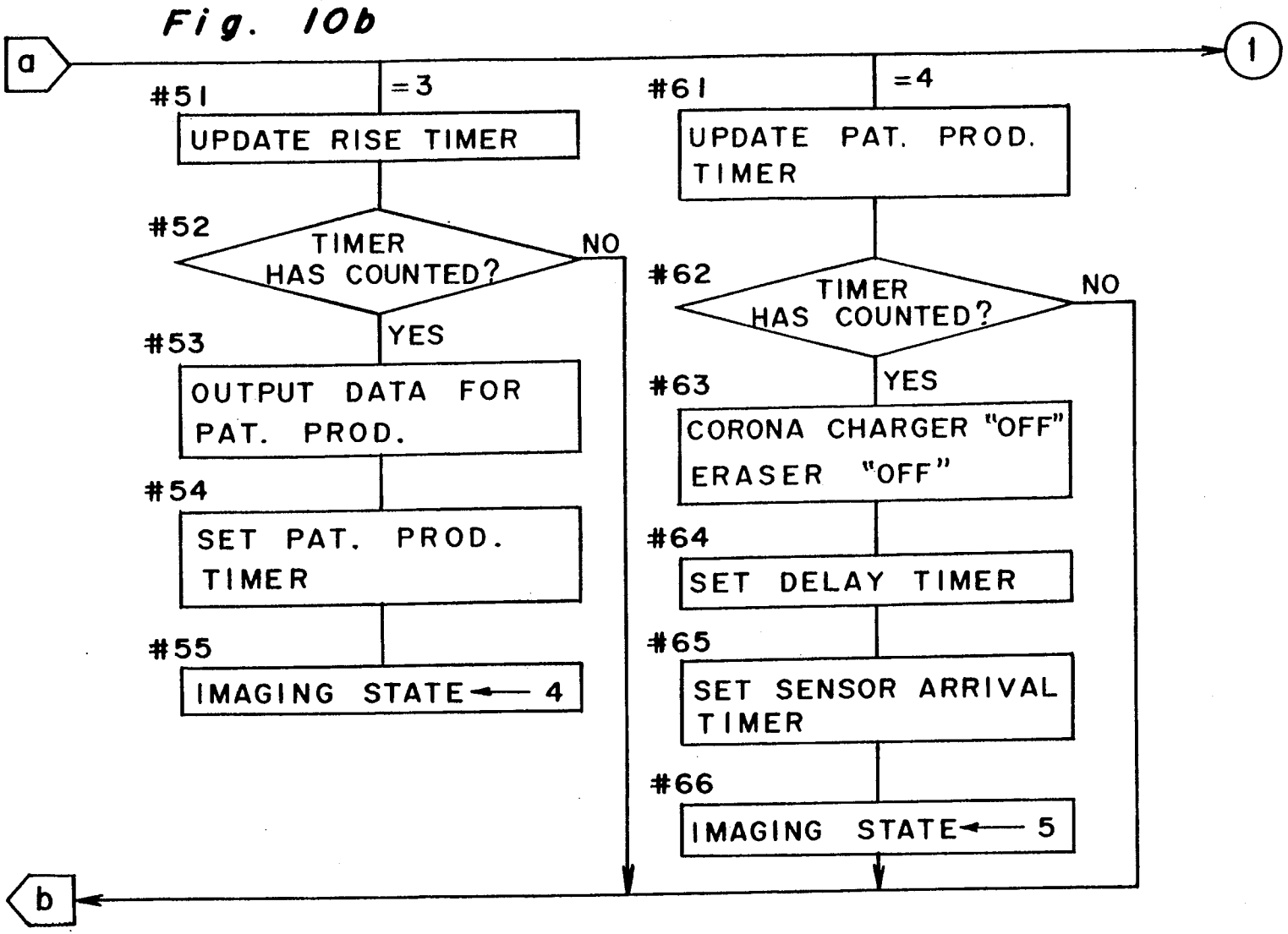
Figure 10C:
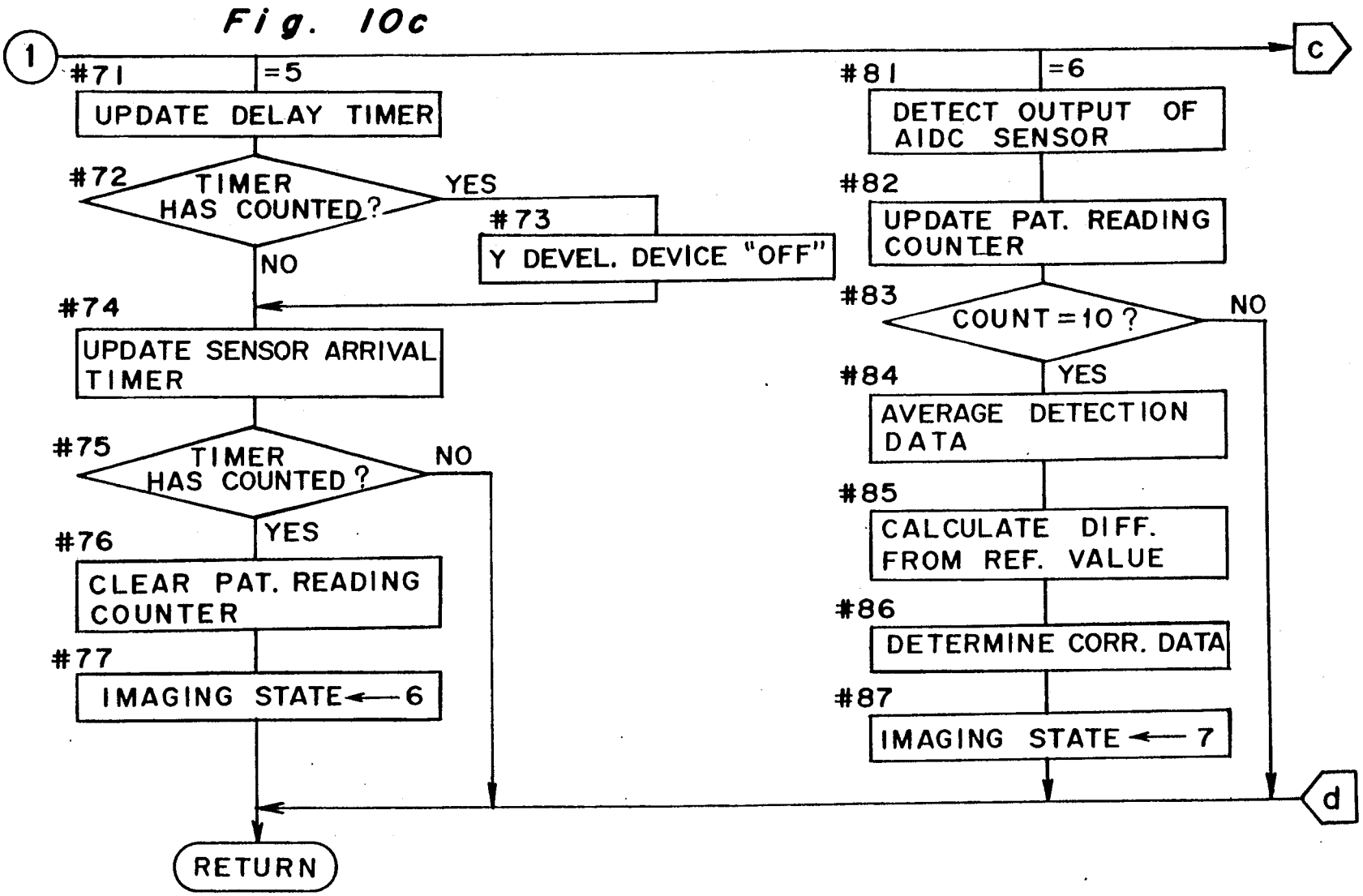
Figure 10D:
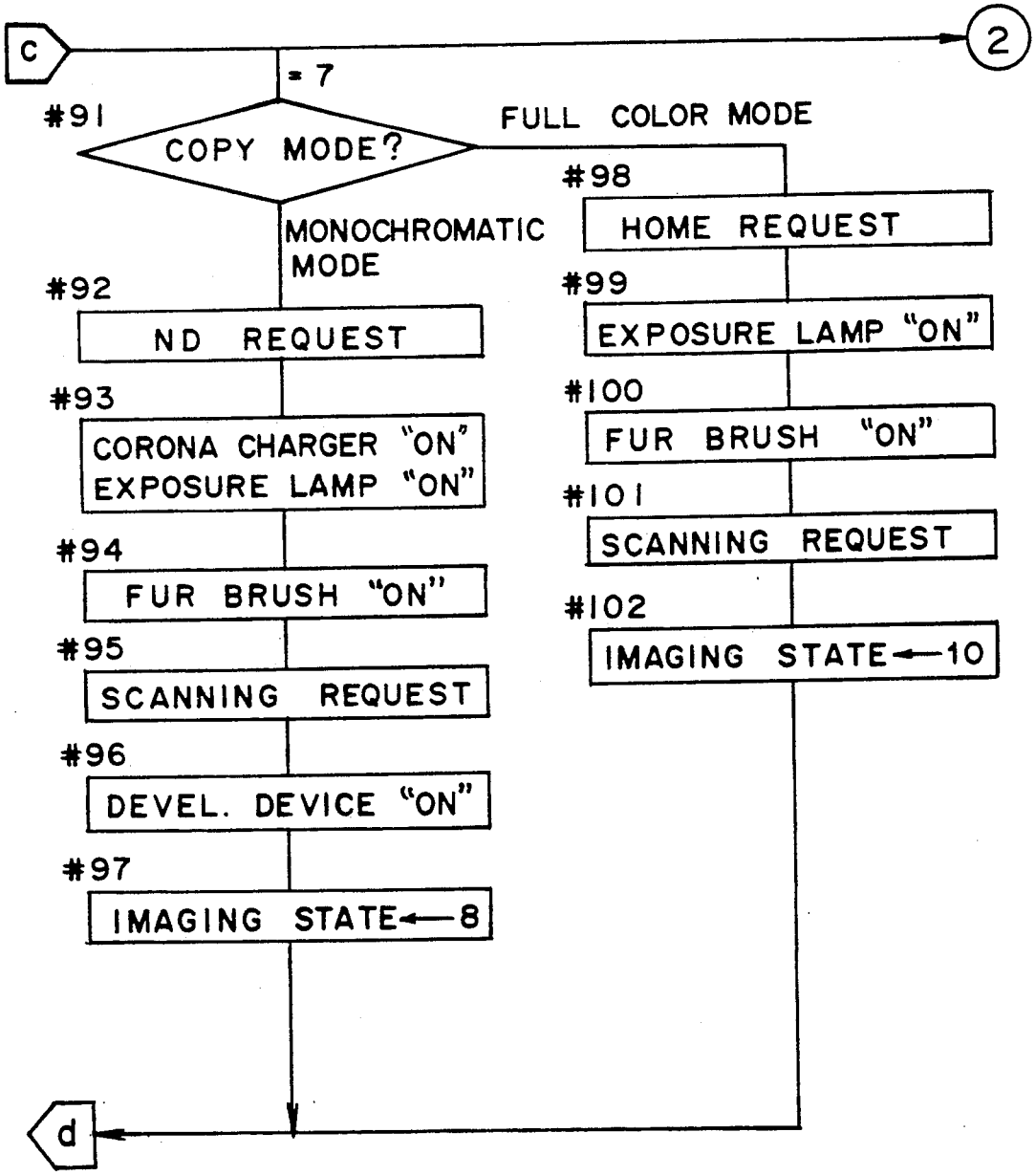
Figure 10E:
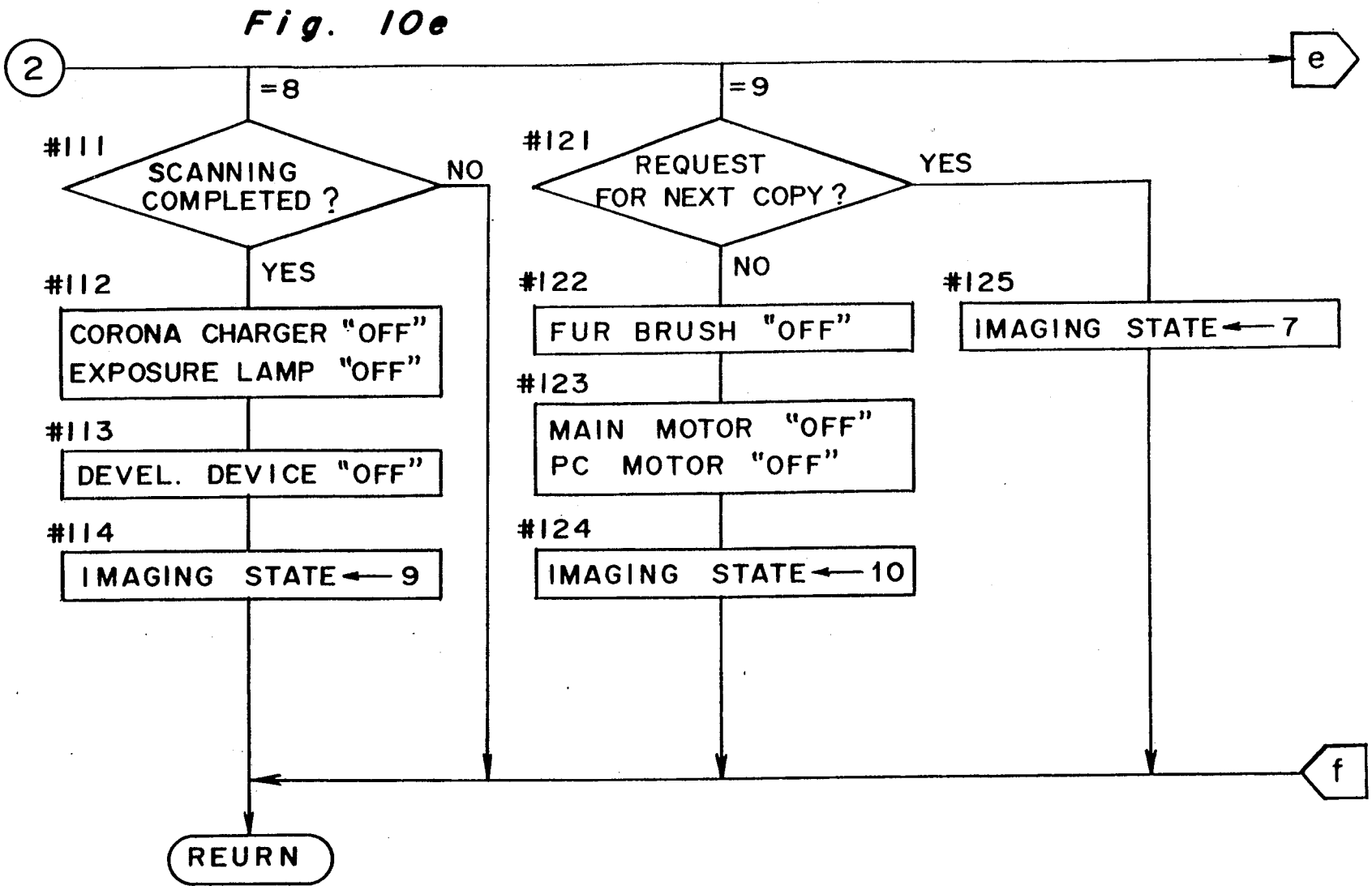
Figure 10F:
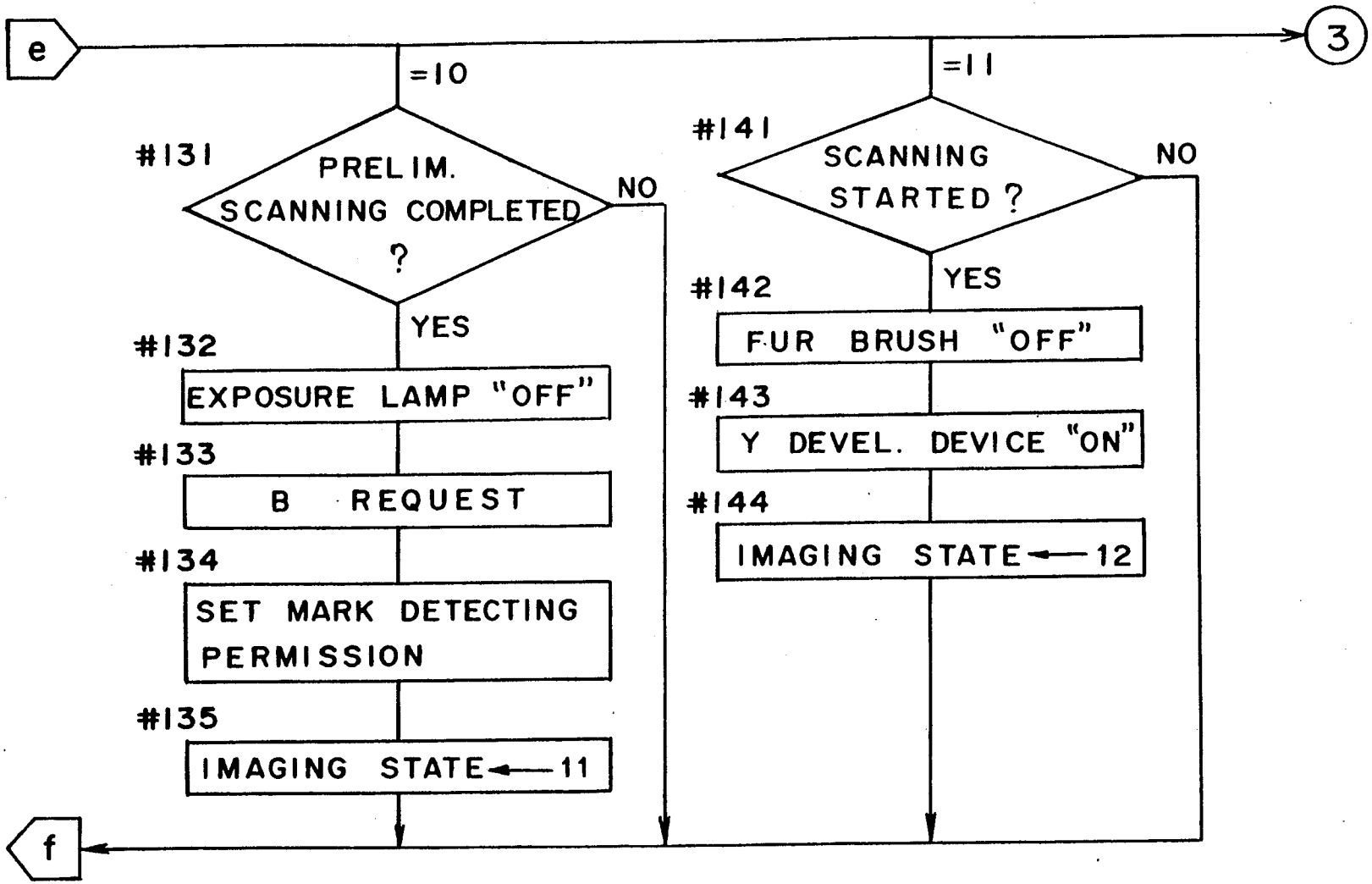
Figure 10G:
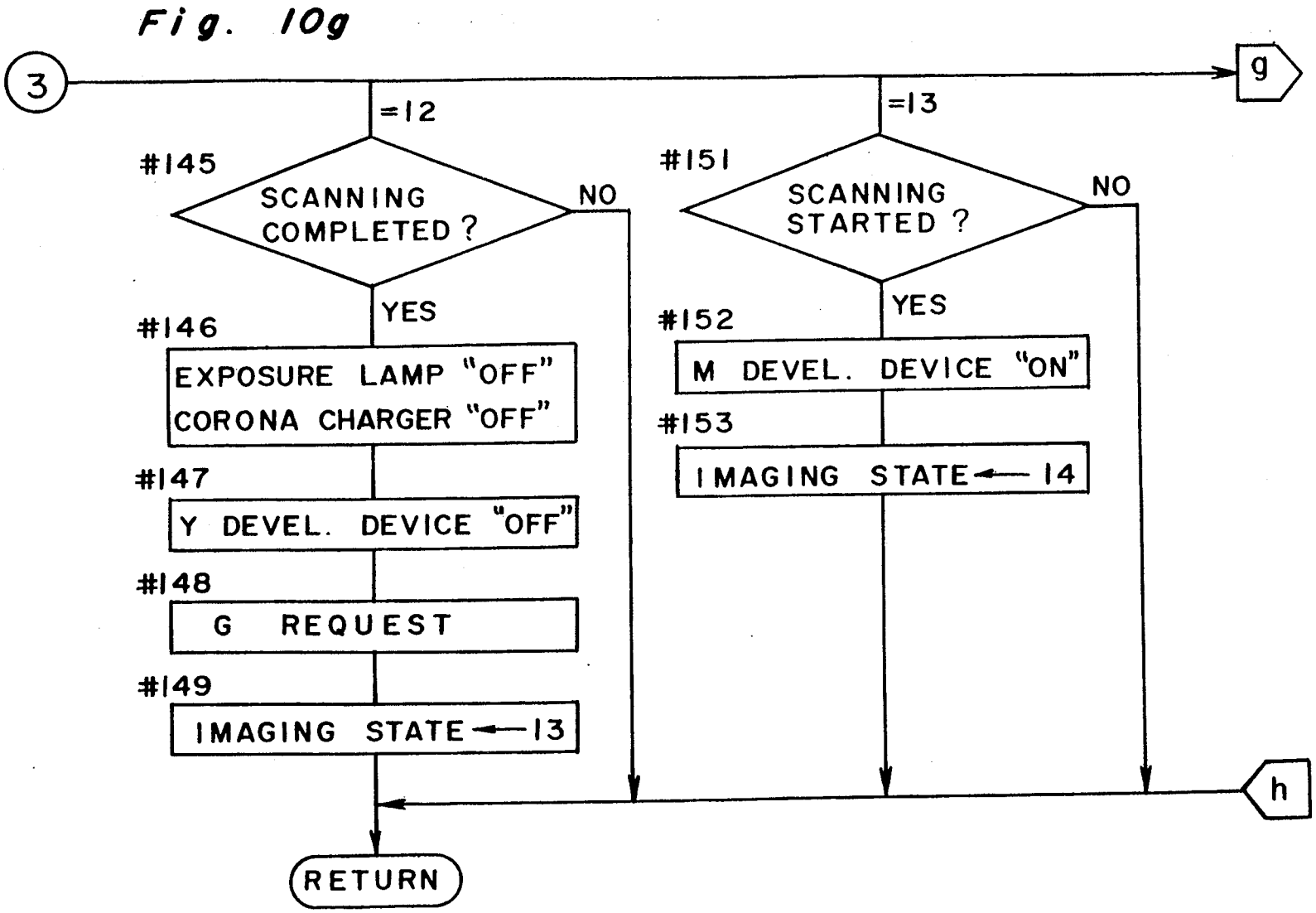
Figure 10H:
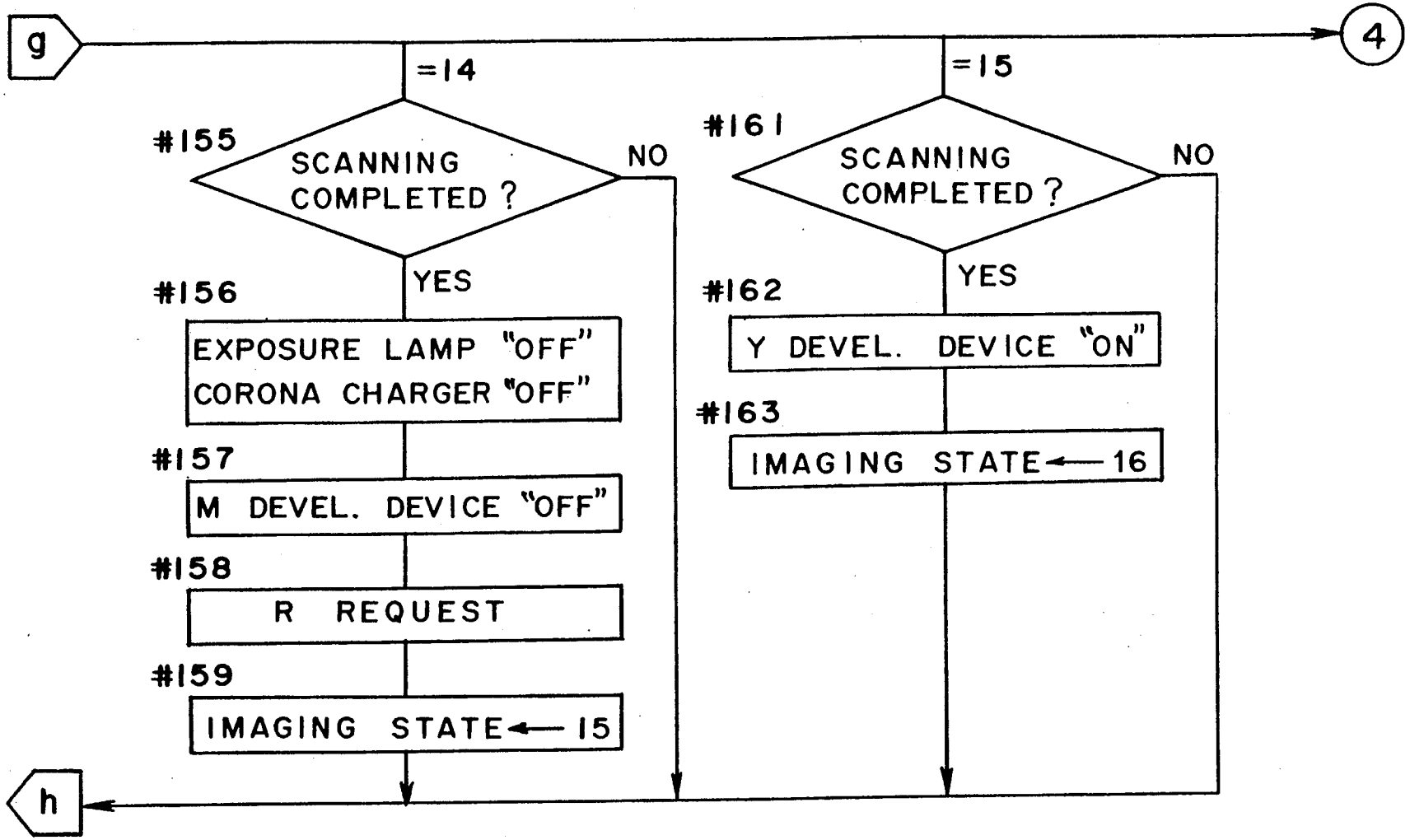
Figure 10I:
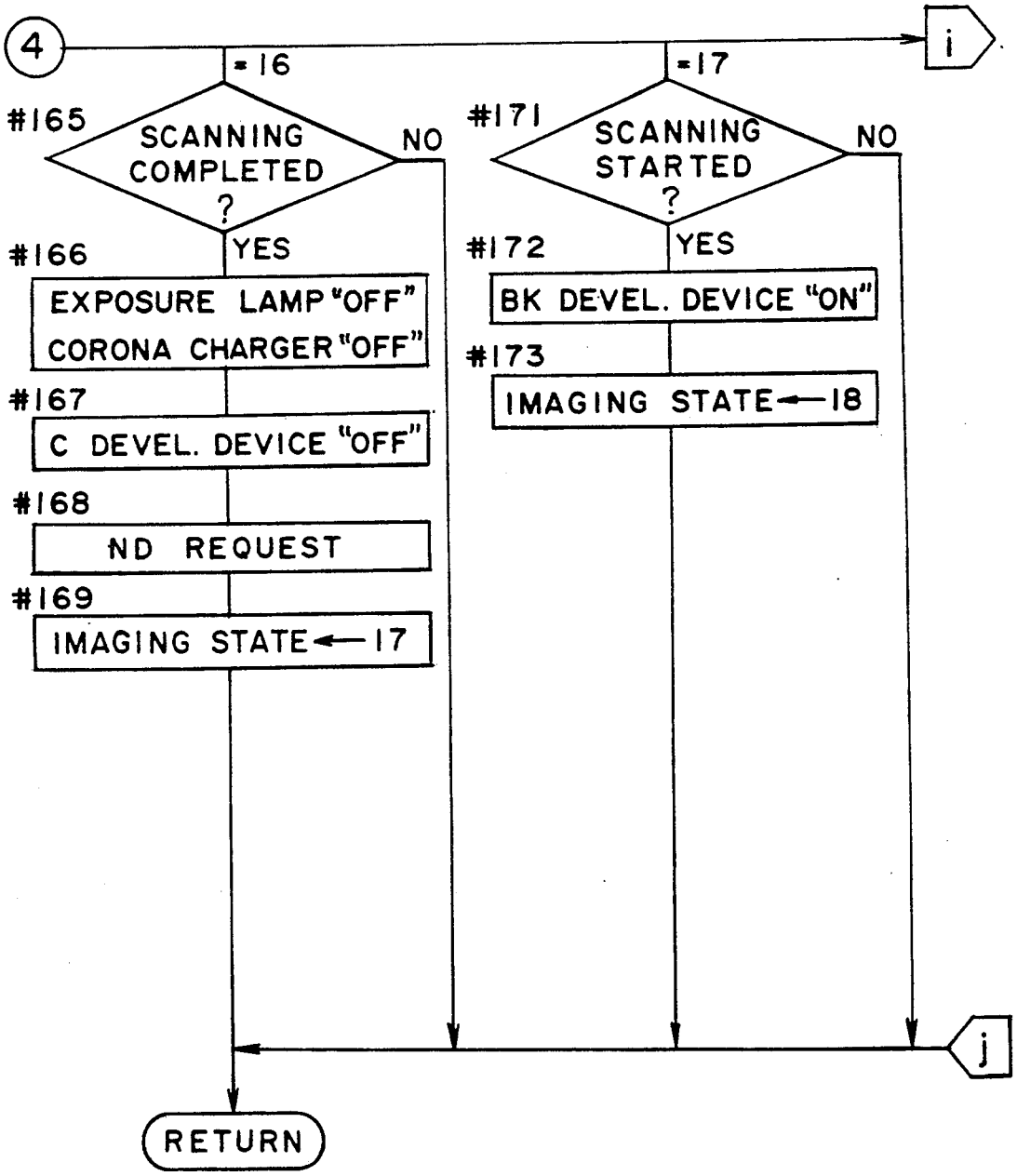
Figure 10J:
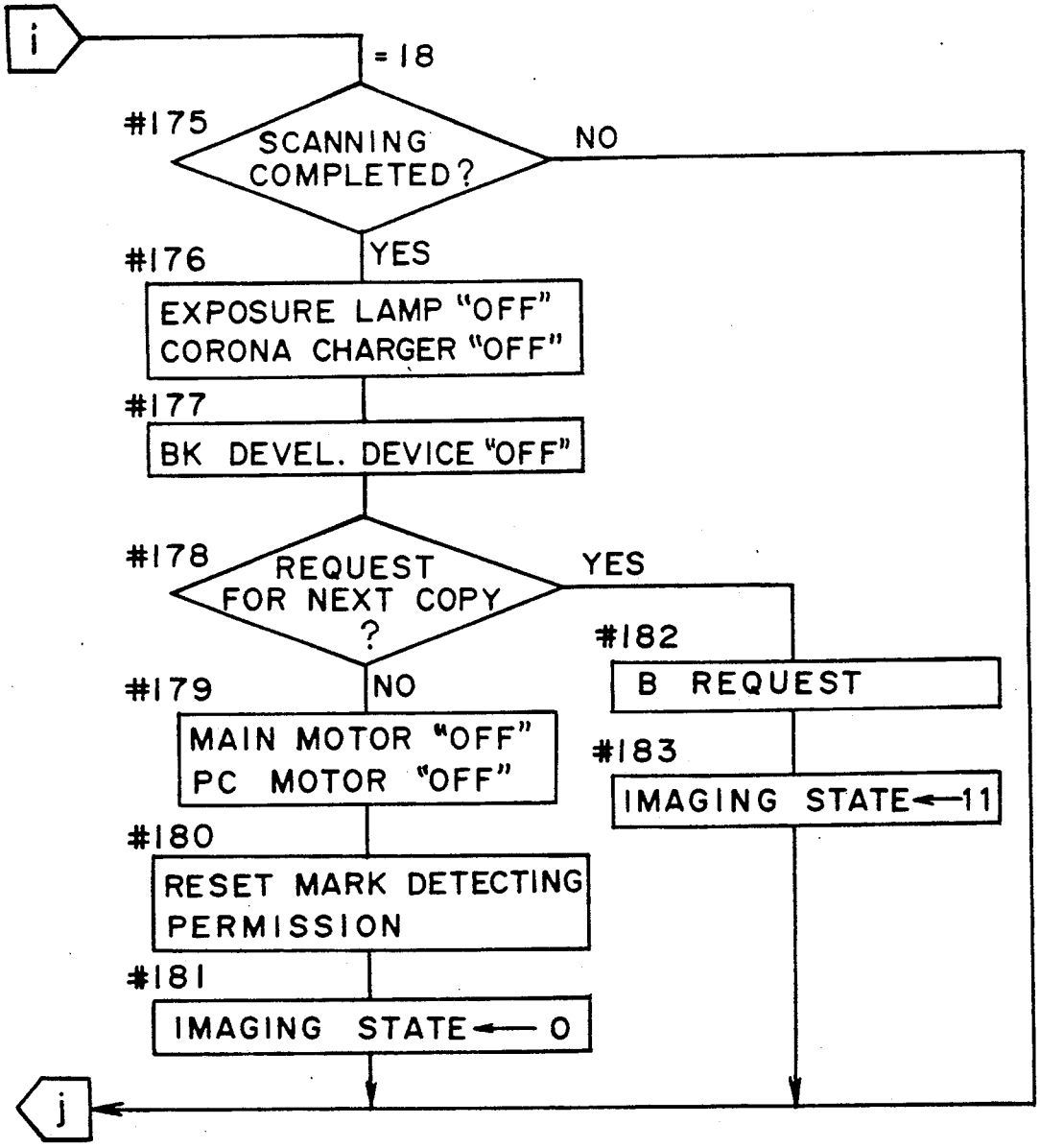

Hereinbelow, operation associated with adjustment of image quality in the copying apparatus 1 is described with reference to flow charts of FIGS. 9 and 10. FIG. 9 is a main flow chart schematically showing operation of the CPU 401. When a program is started upon turning on of a power source, initialization of registers and peripheral interfaces are performed at step #1 and an internal timer for determining length of one routine of the CPU 401 is set at step #2. Then, image forming processing associated with an electrophotographic process, which includes production of the AIDC pattern AP, is performed at step #3 and scanning processing for scanning the original document D is performed at step

#4. Subsequently., belt mark detecting processing for determining timing of multiple transfer is performed at step #5. Thereafter, data on the exposure lamp 33 is outputted at step #6 and data on the grid voltage VG is outputted at step #7. At step #8, a series of sequential operation constituted by various processings such as paper feeding processing for controlling feed and transport of the copy paper sheets P, manual paper feeding processing for determining timing of manual feed of the copy paper sheets P through the manual paper feeding opening 41, temperature processing for adjusting temperature of the fixing unit 51, belt cleaning processing for cleaning the transfer belt 11, lens processing for controlling displacement of the main lens 35 in accordance with copying magnification, input processing for receiving signals from operational keys on the operating panel OP, etc. is performed.

After these processings have been executed, it is judged at step #9 whether or not the internal timer has counted a preset period. In the case of "YES" at step #9, the program flow returns to step #2. Thus, length of one routine of the CPU 401 is set to a fixed value and the processings of steps #2 to #9 are repeated as long as the power source is held in the ON state.

FIGS. 10*a* to 10*j* show image forming processing. In this routine, an imaging state indicated by a count of a state counter is initially checked at step #20 and the following processings are performed in accordance with the imaging state. Meanwhile, initial state immediately after turning on of the power source and waiting state after completion of copying operation, the imaging state is set to "0". In the imaging state "0", it is initially judged at step #21 whether or not a print key is in the ON state. In the case of "YES" at step #21, the main motor 24 and the PC motor 25 are turned on at step #22 so as to start rotational drive of the various portions of the copying apparatus 1, for example, the photosensitive drum 3. Then, a motor rise timer for waiting for stable rotation of the main motor 24 and the PC motor 25 is set at step #23 and the imaging state is set to "1" at step #24.

In the imaging state "1", the motor rise timer is updated at step #31 upon completion of counting of the preset period by the motor rise timer and it is judged at step #32 whether or not the motor rise timer has counted the preset period. In the case of "YES" at step #32, a request (retreat request) for rotation of the mirror device 36 is made at step #33 so as to form the latent image APE of the AIDC pattern AP. Thus, the half mirror 36ND is displaced to a retreat position so as to intercept scanning light of the scanner 30. Thereafter, a request for production of the AIDC pattern AP is made at step #34 and the imaging state is set to "2" at step #35.

In the imaging state "2", it is judged at step #41 whether or not the request for production of the AIDC pattern AP is made. In the case of "YES" at step #41, the developing device 6 for the toner of the color of Y for producing the AIDC pattern is turned on at step #42. Subsequently, the corona charger 4 and the editing eraser 5 are turned on at step #43, a rise timer is set at step 44 and the imaging state is set to "3" at step #45. At this time, the grid voltage VG of the corona charger 4 assumes a fixed value determined for producing the AIDC pattern AP. A preset period of the rise timer is determined based on width of the corona charger 4 and distance from the corona charger 4 to the editing eraser 5 such that the AIDC pattern AP is produced at a position on the photosensitive drum 3 corresponding to the preset period of the rise timer.

In the imaging state "3", the rise timer is updated at step #51. When it is found at step #52 that the rise timer has counted the preset period, eraser data for producing the AIDC pattern AP is outputted to the editing eraser 5 at step #53 such that formation of the latent image APE of the AIDC pattern AP is started. Subsequently, a pattern production timer for determining the length L2 of the AIDC pattern AP is set at step #54 and the imaging state is set to "4" at step #55.

In the imaging state "4", the pattern production timer is updated at step #61. When it is found at step #62 that the pattern production timer has counted a preset period, the corona charger. 4 and the editing eraser 5 are turned off at step #63. Thus, the latent image APE is formed at a predetermined position on the photosensitive drum 3 as shown in FIG. 2. Thereafter, a delay timer is set at step #64, a sensor arrival timer is set at step #65 and the imaging state is set to "5" at step #66. The delay timer has a preset period corresponding to a distance from the editing eraser 5 to the developing device 6 for the toner of the color of Y, while the sensor arrival timer has a preset period during which the AIDC pattern AP reaches a detection position of the AIDC sensor 73.

In the imaging state "5", the delay timer is updated at step #71. If it is found at step #72 that the delay timer has counted the preset period, the developing device 6 for the toner of the color of Y is turned off at step #73. Subsequently, the sensor arrival timer is updated at step #74. If it is found at step #75 that the sensor arrival timer has counted the preset period, a pattern reading counter for counting the number of reading of the AIDC pattern AP is cleared at step #76 and the imaging state is set to "6" at step #77. In this embodiment, the pattern reading counter counts 10 times.

In the imaging state "6", the detection signal S1 of the AIDC sensor 73 is initially read out at step #81. Then, the pattern reading counter is updated at step #82 and it is judged at step #83 whether or not the pattern reading counter has counted 10 times. In the case of "YES" at step #83, the detection data of 10 times at step #81 is averaged at step #84. Detection is performed 10 times in view of scatter of the detection signal S1. By averaging the detection data of 10 times, reliability of the detection data is improved. Thereafter, a difference between the averaged detection data of step #84 and a reference value is calculated at step #85 and thus, it becomes possible to learn how far the density of the current toner image deviates from the reference density. Subsequently, correction data of the corona charger 4 and the exposure lamp 33 in image formation of the respective colors is determined at step #86. This correction data is read out from the image quality adjustment table GT on the basis of the difference calculated at step #85. As described above, the correction data of the colors of Y, M, C and BK corresponding to the value of the detection signal S1 is stored in the image quality adjustment table GT. Thus, by producing the AIDC pattern AP of one color, it is possible to determine the correction data of all the remaining colors. Thereafter, the imaging state is set to "7" at step #87.

In the imaging state "7", a decision is made at step #91 as to whether a copy mode designated by the operating panel is a monochromatic mode or a full color mode. The subsequent processing is performed in accordance with the decision of step #91. If it is found at step #91 that the monochromatic mode is designated, a request (ND request) for rotation of the mirror device 36, which is a flag for demanding positioning of the half mirror 36ND, is set at step #92. Thus, the half mirror 36ND is positioned to its image forming position. Subsequently, the corona charger 4 and the exposure lamp 33 are turned on at step #93, output of the fur brush 19*a* for cleaning the transfer belt 11 is turned on at step #94 and a request for starting scanning of the scanner 30 is set at step #95. Thereafter, one of the developing devices 6 to 9 selected by the operating panel is turned on at step #96 and the imaging state is set to "8" at step #97.

In the imaging state "8", if it is found at step #111 that scanning of the original document D has been completed, the corona charger 4 and the exposure lamp 33 are turned off at step #112, the developing device in operation is turned off at step #113 and the imaging state is set to "9" at step #114.

In the imaging state "9", it is judged at step #121 whether or not a request for the next copy is made. In the case of "NO" at step #121, output of the fur brush 19*a* is turned off at step #122, the main motor 24 and the PC motor 25 are turned off at step #123 and the imaging state is reinstated to "0" at step #124. Thus, the copying apparatus 1 is set in waiting state. Meanwhile, in the case of "YES" at step #121, the imaging state is reinstated to "7" at step #125.

On the other hand, if it is found at step #91 of the imaging state "7" that the full color mode is designated, a request (home request) for positioning the half mirror 36ND to its home position so as to allow the image sensor 38 to read the original document D is set at step #98. Thereafter, the exposure lamp 33 is turned on at step #99 and output of the fur brush 19*a* is turned on at step #100. Subsequently, a request for preliminary scanning is made at step #101 and the imaging state is set to "10" at step #102.

In the imaging state "10", if it is found at step #131 that preliminary scanning has been completed, the exposure lamp 33 is turned off at step #132 and a request (B request) for rotation of the mirror device 36, which is a flag for positioning the filter mirror 36YB to its image forming position, is set at step #133. Subsequently, a mark detecting permission for starting scanning at the time of turning on of the belt mark sensors 72 and 72*s* is set at step #134 and the imaging state is set to "11" at step #135.

In the imaging state "11", it is judged at step #141 whether or not the scanner 30 has started scanning in response to the belt mark signal S10. In the case of "YES" at step #141, output of the fur brush 19*a* is turned off at step #142 and the developing device 6 for the toner of the color of Y is turned on at step #143. Then, the imaging state is set to "12" at step #144.

In the imaging state "12", if it is found at step #145 that scanning has been completed, the corona charger 4 and the exposure lamp 33 are turned off at step #146 and the developing device 6 for the toner of the color of Y is turned off at step #147. Subsequently, a request (G request) for rotation of the mirror device 36, which is a flag for positioning the filter mirror 36MG to its image forming position, is set at step #148 and the imaging state is set to "13" at step #149.

In the imaging states "13" to "18", a series of processings for forming the toner images of the colors of M, C and BK, respectively are performed in the same manner as the above described formation of the toner image of the color of Y. Namely, the developing devices 7, 8 and 9 corresponding to the respective colors are turned on and off, the exposure lamp 33 and the corona charger 4 are turned off upon completion of scanning of the scanner 30, the filter mirror 36CR or the half mirror 36ND corresponding to the subsequent scanning is positioned, etc.

Meanwhile, if it is found at step #178 of the imaging state "18" that a request for the next copy is not made, the main motor 24 and the PC motor 25 are turned off at step #179 and the mark detecting permission is reset at step #180. Then, the imaging state is reinstated to "0" at step #181.

In the above described embodiment, by using the image quality adjustment table GT which preliminarily stores the correction data corresponding to variations of humidity, density of each of the toner images of the respective colors is adjusted. Therefore, it is not necessary to provide a humidity sensor for detecting humidity in the copying apparatus 1.

Meanwhile, in the above described embodiment, the AIDC pattern AP is produced by using the developing device 6 of the color of Y. However, one of the remaining developing devices 7 to 9 or one of the developing devices 6 to 9 selected for copying may also be used. In the latter case, the correction data may be determined at step #86 in accordance with one of the developing devices 6 to 9 to be used.

Furthermore, in this embodiment, setting of the grid voltage VG and the voltage VL is changed in accordance with the detection signal S1 such that amounts of the toners of the respective colors adhering to the photosensitive drum 3, i.e. densities of the respective toner images are adjusted. However, densities of the toner images of the respective colors may also be adjusted by changing setting of developing biases at the developing devices 6 to 9 or both the developing biases at &:he developing devices 6 to 9 and the voltage VL or the grid voltage VG.

In this embodiment, the image quality adjustment table GT which stores the correction data corresponding to the toners of the colors of Y, M, C and BK is provided. However, in the case where toners in which degrees of variations of amounts QT of the toners are identical with each other are employed, the correction data can be used in common for these toners.

Meanwhile, in this embodiment, adjustment of image quality in the copying apparatus 1 is described by way of example. However, the present invention can also be applied to an image forming apparatus such as a page printer in which image formation is performed by an electrophotographic process.

Furthermore, in this embodiment, contents of the image quality adjustment table GT can be selected in accordance with characteristics of variations of the amount QT of the toner due to environmental changes such as humidity, temperature, etc. or deterioration of the photosensitive drum 3 with time. In addition, constructions, shapes, dimensions, materials, etc. of the respective portions of the copying apparatus 1 can be modified variously.

In accordance with the present invention, it becomes possible to not only minimize consumption of the toner for adjustment of image quality but reduce a period required for performing adjustment of image quality.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of setting image data for a plurality of developers, comprising the steps of:

forming a first toner image on the image support member with a first developer in response to first image data;

detecting the first toner image so as to output a detection signal;

changing the first image data in accordance with the detection signal; and changing second image data for a second developer in accordance with a predetermined relationship each time the first image data is changed in accordance with the detection signal.

2. A method as claimed in claim 1, wherein the second developer is different from the first developer with respect to their colors.

3. A method as claimed in claim 2, wherein the detection signal corresponds to a density of the first toner image.

4. The method of claim 1, wherein the predetermined relationship is a table of fixed data.

5. A method of forming an image by supporting a plurality of kinds of toner images on a photosensitive member, comprising the steps of:

charging the photosensitive member with a first latent image voltage-potential;

forming a first electrostatic latent image by exposing the charged photosensitive member with a first amount of exposure;

developing the first electrostatic latent image with first toner so as to form a reference image with the first toner with a first developing bias voltage;

detecting a density of the reference image so as to generate a detection output;

charging the photosensitive member with a second latent image voltage-potential;

forming a second electrostatic latent image by exposing the charged photosensitive member with a second amount of exposure;

developing the second electrostatic latent image with second toner which is different from the first toner with a second developing bias voltage; and changing at least one of the first latent image voltage-potential, the first amount of exposure and the first developing bias voltage in accordance with the detection output; and setting at least one of the second latent image voltage-potential, the second amount of exposure and the second developing bias voltage in accordance with a predetermined relationship of the first latent image voltage-potential, the second latent image voltage-potential, the first amount of exposure, the second amount of exposure, the first developing bias voltage and the second developing bias voltage, which predetermined relationship is stored in a memory, when at least one of the first latent image voltage potential, the first amount of exposure and the first developing bias voltage have been changed in accordance with the detection output.

6. A method as claimed in claim 5, wherein the program further sets at least one of the first latent image voltage-potential, the first amount of exposure and the first developing bias voltage.

7. A method as claimed in claim 5, wherein the above steps are continuously performed a predetermined number of times at the control output set once.

8. A method as claimed in claim 5, wherein the control output is set in accordance with a difference between the detection output and a predetermined reference output.

9. A method as claimed in claim 5, wherein the density of the reference image is detected photoelectrically.

10. The method of claim 5, wherein the predetermined relationship is a table of fixed data.

11. A method of forming an image by supporting a plurality of kinds of toner images on a photosensitive member, comprising the step of:

forming a first electrostatic latent image on a surface of the photosensitive member on the basis of first image forming conditions;

developing the first electrostatic latent image with first toner;

forming a reference electrostatic latent image on the surface of the photosensitive member on the basis of reference image forming conditions;

developing the reference electrostatic latent image with the first toner so as to form a reference image;

outputting an image density signal corresponding to a density of the reference image;

executing, in response to an output of the image density signal, a program for setting second image forming conditions for forming a second electrostatic latent image;

forming the second electrostatic latent image on the surface of the photosensitive member in accordance with the second image forming conditions; and developing the second electrostatic latent image with second toner which is different from the first toner;

wherein the program selects, on the basis of a difference between the output of the image density signal and a predetermined reference value, the second image forming conditions from a plurality of preset image forming conditions.

12. A method as claimed in claim 11, wherein the program sets, by the output of the image density signal, the first image forming conditions in addition to the second image forming conditions.

13. A method as claimed in claim 11, wherein the second image forming condition includes at least one of a corona charging potential, an image exposure intensity and a developing bias voltage, wherein the second electrostatic latent image is formed by such a way that the photosensitive member is charged by the charging potential and the charged photosensitive member is exposed by the image exposure intensity, and the second electrostatic latent image is developed by the developing bias voltage.

14. A method as claimed in claim 13, wherein when the output of the image density signal is larger than the predetermined reference value, the corona charging potential is lowered or the image exposure intensity is lowered.

15. A method of forming an image by supporting a plurality of kinds of toner images on a photosensitive member, comprising the steps of:

forming a first electrostatic latent image on a surface of the photosensitive member in accordance with first image forming conditions;

developing the first electrostatic latent image with a first color toner;

forming a reference electrostatic latent image on the surface of the photosensitive member in accordance with reference image forming conditions;

developing the reference electrostatic latent image with the first color toner;

outputting an image density signal corresponding to a density of the developed reference image;

executing, by an output of the image density signal, a program for setting second image forming conditions for forming a second electrostatic latent image to be developed with a second color toner;

forming the second electrostatic latent image on the surface of the photosensitive member on the basis of the second image forming conditions; and developing the second electrostatic latent image with the second color toner, wherein the program selects, on the basis of a difference between the output of the image density signal and a predetermined reference value, the second image forming conditions from a plurality of preset image forming conditions.

16. A method as claimed in claim 15, wherein the program sets, by the output of the image density signal, the first image forming conditions in addition to the second image forming conditions.

17. A method as claimed in claim 15, wherein the present image forming conditions include at least one of a corona charging output, an image exposure intensity and a developing bias.

18. An image forming apparatus having a plurality of developing devices, comprising:

an electrostatic latent image support member;

a latent image forming means for forming an electrostatic latent image on the electrostatic latent image support member;

a first developing means for developing with first toner on the basis of first image conditions, the electrostatic latent image formed by the latent image forming means;

a second developing means for developing with second toner on the basis of second image conditions, the electrostatic latent image formed by the latent image forming means;

a storage means for storing a predetermined relationship between the first image conditions and the second image conditions;

a first change means for changing the first image conditions; and a second change means for automatically changing, each time the first image conditions have been changed by the first change means, the second image conditions in accordance with the predetermined relationship stored in the storage means.

19. An image forming apparatus as claimed in claim 18, further comprising:

a reference latent image forming means for forming a reference electrostatic latent image on the electrostatic latent image support member on the basis of reference image conditions;

a reference image forming means for developing the reference electrostatic latent image by the first developing means so as to form a reference image; and an output means for outputting a density signal corresponding to a toner density of the reference image;

wherein said first changing means changes the first image conditions in accordance with an output of the density signal.

20. An image forming apparatus as claimed in claim 18, wherein the storage means stores the first image conditions and the second image conditions.

21. An image forming apparatus as claimed in claim 20, wherein the first toner has a color different from that of the second toner.

22. An image forming apparatus as claimed in claim 21, wherein the first image conditions and the second image conditions include at least one of a corona charging output, an image exposure intensity and a developing bias.

23. An image forming apparatus as claimed in claim 22, wherein when the output of the density signal is larger than the output of the predetermined reference density, the corona charging output is lowered or the image exposure intensity is lowered.

24. An image forming apparatus as claimed in claim 18, wherein the predetermined relationship is a table of fixed data.

25. An image forming apparatus having a plurality of developing device, comprising:

an image support member;

means for forming an electrostatic latent image onto the support member;

first developing means for developing the formed latent image with a first developer including a first toner and a first carrier in accordance with first image conditions;

means for maintaining a ratio of the first toner of the first developer to be fixed value;

second developing means for developing the formed latent image with a second developer including a second toner and a second carrier in accordance with second imaged conditions;

means for maintaining a ratio of the second toner of the second developer to be a fixed value;

means for detecting the toner image developed with the first toner to produce a detection signal;

first changing means for changing the first image conditions in response to the detection signal;

means for storing a predetermined relationship between the first image conditions and the second image conditions; and second changing means for changing the second image conditions in accordance with the predetermined relationship when the first image conditions have been changed by the first changing means.

* * * * *